US011648702B2

(12) United States Patent
Lizarazu Gonzalez et al.

(10) Patent No.: US 11,648,702 B2
(45) Date of Patent: May 16, 2023

(54) DETACHABLE CUTTING ASSEMBLY

(71) Applicant: SAMMIC, S.L., Guipuzcoa (ES)

(72) Inventors: Tomas Lizarazu Gonzalez, Guipuzcoa (ES); Aitor Aguirrezabalaga, Guipuzcoa (ES)

(73) Assignee: SAMMIC, S.L., Azkoitia (ES)

( * ) Notice: Subject to any disclaimer, the term of this patent is extended or adjusted under 35 U.S.C. 154(b) by 0 days.

(21) Appl. No.: 17/516,960

(22) Filed: Nov. 2, 2021

(65) Prior Publication Data

US 2022/0203571 A1 Jun. 30, 2022
US 2022/0203571 A1 Jun. 30, 2022

(30) Foreign Application Priority Data

Dec. 29, 2020 (ES) ..... ES202031310

(51) Int. Cl.
*B26D 7/26* (2006.01)
*B26D 1/143* (2006.01)
*B26D 1/00* (2006.01)

(52) U.S. Cl.
CPC ..... *B26D 7/2635* (2013.01); *B26D 1/143* (2013.01); *B26D 2001/0046* (2013.01); *B26D 2210/02* (2013.01)

(58) Field of Classification Search
CPC .. B26D 7/2635; B26D 1/143; B26D 2210/02; B26D 2001/0046; A47J 43/06
USPC ..... 83/482
See application file for complete search history.

(56) References Cited

U.S. PATENT DOCUMENTS 9,301,647 B2 * 4/2016 Ekström ..... A47J 43/07
2013/0228642 A1 9/2013 Beber

FOREIGN PATENT DOCUMENTS

DE 20006089 U1 * 8/2000 ..... A47J 43/0711
EP 3064110 A1 * 9/2016
EP 3064110 A1 * 9/2016
ES 2477519 T 7/2014
ES 2734208 T 12/2019
GB 388154 A * 2/1933
SE 1150664 A1 10/2012

* cited by examiner

*Primary Examiner* — Nhat Chieu Q Do
(74) *Attorney, Agent, or Firm* — Craft Chu PLLC; Andrew Chu

(57) ABSTRACT

An improved detachable cutting assembly used in a food cutting machine includes a rotating disc with a window and a pivot hole. A flap is connected radially to the rotation axis of the cutting machine by its insert ring. The insert ring includes a fixing area in which at least one nut is embedded and on which there is at least one fastening hole coinciding with the at least one nut, and a lifting wedge on which a blade is partially embedded, leaving the cutting edge of the blade protruding on the upper face of the rotating disc through the window of the rotating disc. Existing in the fixing area of the rotating disc, there is at least one fastening hole coinciding with the at least one fastening hole and the at least one nut of the flap and capable of fixing the whole assembly by linking elements.

4 Claims, 3 Drawing Sheets

DETACHABLE CUTTING ASSEMBLY

BACKGROUND OF THE INVENTION

1. Field of the Invention

This invention concerns an improved detachable cutting assembly. More specifically, it refers to an improved detachable cutting assembly used in food cutting machines in professional kitchens, structured on the basis of a rotating disc consisting of a window and a pivot hole linked to the rotation axis of the cutting machine, to which a flap containing the cutting blade is inserted into the lower face of the rotating disc, linked to the rotation axis of the cutting machine by means of its insert ring.

In this kind of food cutting machine, the rotating disc is inserted into a tray through the rotation axis and when the food product is introduced, it is cut into slices by means of the continuous rotation of the disc in which the blade is located. These machines are required to allow a multiplicity of slice thickness ranges, so having easily replaceable and interchangeable elements allowing for versatility in thickness is very relevant. Moreover, it is essential that all the elements of the assembly can be cleaned easily, as this is an essential requirement detailed in food machinery regulations, for example in NSF/ANSI 8, in which it is required that the set of blades may be easily disassembled for cleaning when the cutting process requires a unitary assembly.

2. Description of Related Art Including Information Disclosed Under 37 CFR 1.97 and 37 CFR 1.98

In the current state of the art, cutting assemblies are known in which the cutting element is welded directly to the rotating disc, which is arranged inside the tray of the cutting machine, this being a clear disadvantage, resulting in the impossibility of removing the blade for proper cleaning, not complying with the corresponding regulations, and resulting in an accumulation of residues under the edge of the blade that can cause jams and limit the cutting capacity of the machine, increasing the time needed to cut the food optimally. The cutting assembly of the present invention addresses this situation by making the blade removable, facilitating its cleaning and avoiding possible waste jams. In the cases in which the blade is welded onto the disc, the existence of different cutting discs is required for each different thickness of the slice required, which implies a greater need for storage space and an increase in expenditure on accessories for the cutting machine, since the cost of a disc, normally made of stainless steel, is high. Furthermore, there are cutting assemblies in which the blade is screwed directly onto the rotating disc. The negative effect of this configuration is that the integrity of the fixings of the flap to the rotating disc is weakened due to the damaging vibrations caused by the continued striking of the food on the blade during the cutting of the food, posing a risk to the user and leading to broken slices of food or with an undesirable appearance because there will be a mismatch of the cutting element, which is rotating at high speed during the food's cutting process. The present invention addresses this situation by incorporating a safety component to the flap to increase the integrity of the fixings during the food cutting process and guarantee a safe use of the cutting machine.

BRIEF SUMMARY OF THE INVENTION

Compared to the state of the art described above, the present invention has as its subject an improved removable cutting assembly used in food cutting machines that consists of a rotating disc with a window and a pivot hole linked to the rotation axis of the cutting machine, to which a flap radially linked to the rotation axis of the cutting machine is inserted into the lower face of the rotating disc by means of its insert ring, in which the flap consists of; a fixing area in which at least one nut is embedded and on which there is at least one fastening hole coinciding with at least one nut, and a lifting wedge on which a blade is partially embedded, leaving the cutting edge of the blade protruding over the upper face of the rotating disc through the window of the rotating disc, and the flap attachment area is below the rotating disc attachment area and there is at least one rotating disc attachment area mooring hole coincident with the mooring hole and the wing nut and capable of fixing the whole assembly by means of linking elements.

In the first place, in order to specify the concepts used in the present invention, it is indicated that; when reference is made to linking elements, this refers to elements that prevent relative movement between the different elements of the present invention, these being the ones usually used, such as screws, threaded rods or any element equipped with fixing capacity.

Due to this configuration, the removable cutting assembly provides greater versatility for its use, using flaps with lifting wedges of different heights and these can be easily replaced by the user using common tools in professional kitchens. In this manner, slices of food of different thicknesses are obtained, adapting to the needs of the user. Moreover, cleaning is facilitated, since the flap in which the blade is partially embedded is removable, this being a fundamental requirement in the field of food product production and guaranteeing food safety. In addition, the fact that the nuts are embedded in the fixing area of the flap means that the exchange and/or replacement of the flap by kitchen personnel will be much simpler, since they must attend to the extraction of the connecting elements, screws, without worrying about removing the nuts to disassemble the assembly. With this linking configuration of the elements, in which the containing flap of the cutting blade is partially inserted in the lower face of the rotating disc and partially protruding on the upper face of the disc, a better fixation of the cutting element—blade— of the flap is achieved, as it is trapped and its movement limited not only by the linking elements, but also by the entire surface of the fixing area of the rotating disc. In addition, by foreseeing that the lifting wedge is manufactured by plastic injection on the blade and the nuts, the possibility of accumulation of food residues is eliminated, thus eliminating the possible contamination of the food and reducing their cutting time, since an accumulation of residues causes a loss of cutting efficiency. Furthermore, when the user requires the use of different flaps to obtain different slice thicknesses, he will only have to modify, at the time of manufacture, the dimensions of the plastic flap, the blade having the same dimensions for all slice thicknesses. This entails a significant reduction in manufacturing costs since the flap injection material is plastic, which is significantly cheaper than steel, which is the usual raw material from which the blade is manufactured. Another advantageous aspect of this configuration is that the elevation of the cutting edge of the blade projecting over the upper face of the rotating disc is determined by the height of the lifting wedge of the flap and the angle of incline thereof (between 21° and 23°), achieving an incline as smooth and minimal as possible, optimizing the cutting of the food slices, without spoiling or damaging the product and avoiding breakage in the fibre of delicate foods, such as tomatoes or similar, and, in this manner, the desired thickness cut can be performed without damaging them, the final appearance of the product being crucial in professional kitchens.

Another technical aspect of the present invention is that the window of the rotating disc has a dimension and geometry corresponding to the dimension and geometry of the lifting wedge of the flap. Due to this characteristic, the lifting wedge of the flap is perfectly inserted into the rotating disc, being efficiently housed and allowing the edge of the blade to protrude from the upper face of the disc, thus achieving an efficient cutting of the food slices without these being damaged, as well as a greater adjustment and fixation of the blade, its movements or vibrations being limited by the coupling with the window in almost the entire perimeter of the lifting wedge.

Another advantageous characteristic of the present invention is that, on the area of attachment of the rotating disc and attached to the lifting wedge, a security component is incorporated consisting of at least one mooring hole coincident with at least one mounting hole of the rotating disc and at least one tie-down hole, and one wing nut. Thanks to the introduction of the safety component attached along the opposite side to the blade of the lifting wedge, a distribution of forces is produced ensuring the fixation of both the blade and the flap to the rotating disc and increasing the integrity of the fixation. In addition, by using this safety component, there is a reduction in the damaging vibrations caused by the striking of the food against the blade during the cutting process, which weaken the adjustment of the fixings, thus achieving the homogenization of the thickness in the food slices, their integrity and a homogeneous appearance therebetween.

Lastly, another advantageous aspect of the present invention is that the profile of the rotating disc may contain a levelling platform in the fixing area and the perimeter of the pivot hole of the rotating disc levelling the rising portion of the cutting edge of the blade on the upper face of the rotating disc. With the presence of this platform, which must be located on the lower face of the disc, a greater range of thickness of food slices can be achieved with the use of a smaller number of lifting wedges, thereby providing the present invention with greater versatility. For example, with wedge angles of 21° and 23° and heights of 1 mm, 2 mm and 3 mm, up to 6 different slice thicknesses can be achieved. With said platform in the disc profile, a projection or protrusion is generated on the underside of the rotating disc, the side on which the lifting wedge containing the cutting blade is inserted, which means reducing the height of the inserted lifting wedge. Thus, when incorporating, for example, a lifting wedge with a height of 2 mm that would allow slices of 2 mm to be obtained when using a rotating disc without a levelling platform, or slices of 5 mm would be obtained if we use a rotating disc with a levelling platform of 3 mm.

BRIEF DESCRIPTION OF THE SEVERAL VIEWS OF THE DRAWINGS

In order to better understand the nature of the invention, an arrangement is presented in the attached drawings which is merely illustrative and non-limiting.

Figure 1:
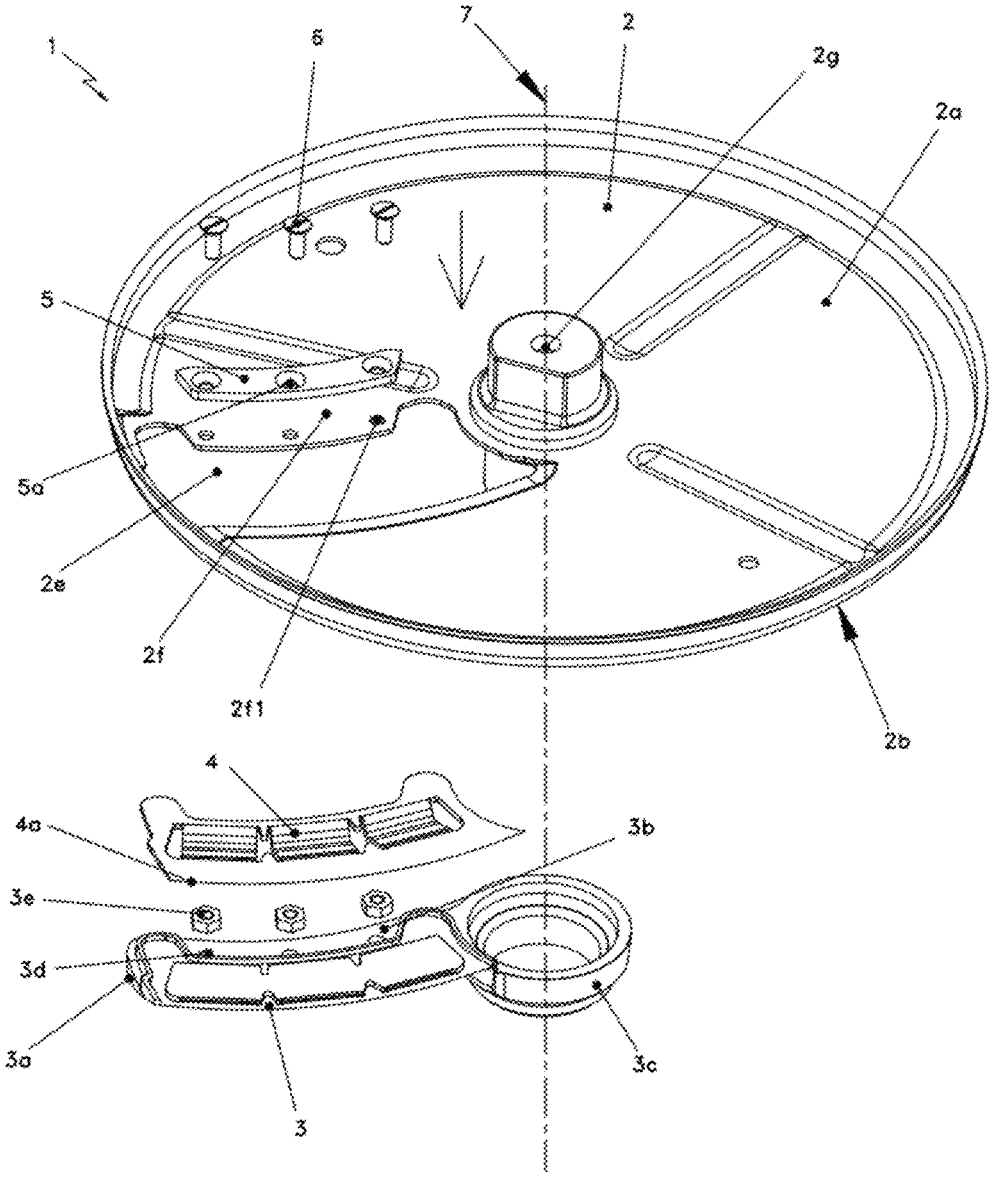
FIG. 1 shows an exploded perspective view of the improved removable cutting assembly (1) consisting of a rotating disc (2), with a window (2*e*), which will be axially attached by means of the rotation axis (7) of the machine cutting machine (not shown) inside the tray (not shown) and a pivot hole (2*g*) linked to the turning axis (7) of the cutting machine, in which will be inserted into the lower face (2*b*) of the rotating disc (2) a flap (3) linked to the rotation axis (7) of the cutting machine by means of its insert ring (3*c*). It is further shown that the flap (3) consists of; an attachment or flap fixing area (3*b*) in which nuts (3*e*) will be embedded and on which mooring bores (3*d*) are located axially coincident with the nuts (3*e*), and a lifter wedge (3*a*) on which a blade (4) is embedded, leaving the cutting edge (4*a*) of the blade (4) raised on the upper face (2*a*) of the rotating disc (2) through the window (2*e*) of the rotating disc (2) and arranged for cutting, and the flap fixing area (3*b*) of the flap (3) being below the disc fixing area (2*f*) of the rotating disc (2). Lastly, in the disc fixing area (2*f*) of the rotating disc (2) are shown: the fastening disc holes (2*f*.1) axially coinciding with the fastening flap holes (3*d*) and the nuts (3*e*) of the flap (3), and the elements of union (6) that axially fix the safety component (5), through its fastening or mooring holes (5*a*), and the flap (3) together with the blade (4) to the rotating disc (2).

In these figures, the following references are indicated:

1. Improved removable cutting assembly
2. Rotating disc
2*a*. Upper face
2*b*. Bottom face
2*c*. Rotating disc profile (2)
2*d*. Levelling platform
2*e*. Window
2*f*. Rotating disc fixing area (2)
2*f*.1. Rotating disc mounting holes (2)
2*g*. Pivot hole
3. Flap
3*a*. Lifting wedge
3*b*. Fixing area
3*c*. Insert ring
3*d*. Mooring holes of the flap (3)
3*e*. Nuts
4. Blade
4*a*. Cutting edge
5. Safety component
5*a*. Mooring holes of the safety component (5)
6. Linking elements
7. Rotation axis of the cutting machine

DETAILED DESCRIPTION OF THE INVENTION

With regard to the above-listed drawings and references, a preferred mode of execution of the object of the invention is illustrated in the attached drawings referring to an improved removable cutting assembly (1) used in food cutting machines that consists of a rotating disc (2) with a window (2*e*) and a pivot hole (2*g*) linked to the rotation axis of the cutting machine (7), to which a flap (3) connected radially to the rotation axis of the cutting machine (7) by means of its insert ring (3*c*) in which the flap (3) consists of; a fixing area (3*b*) in which at least one nut (3*e*) is embedded and on which there is at least one fastening hole (3*d*) coinciding with at least one nut (3*e*), and a lifting wedge (3*a*) on which a blade (4) is partially embedded, leaving the cutting edge (4*a*) of the blade (4) protruding on the upper face (2*a*) of the rotating disc (2) through the window (2*e*) of the rotating disc (2), and the fixing area (3*b*) of the flap (3) being below the fixing area (2*f*) of the rotating disc (2) and existing in the fixing area (2*f*) of the rotating disc (2) at least one fastening hole (2*f*.1) coinciding with the fastening hole (3*d*) and the nut (3*e*) of the flap (3) and capable of fixing the whole assembly by means of linking elements (6).

Figure 2:
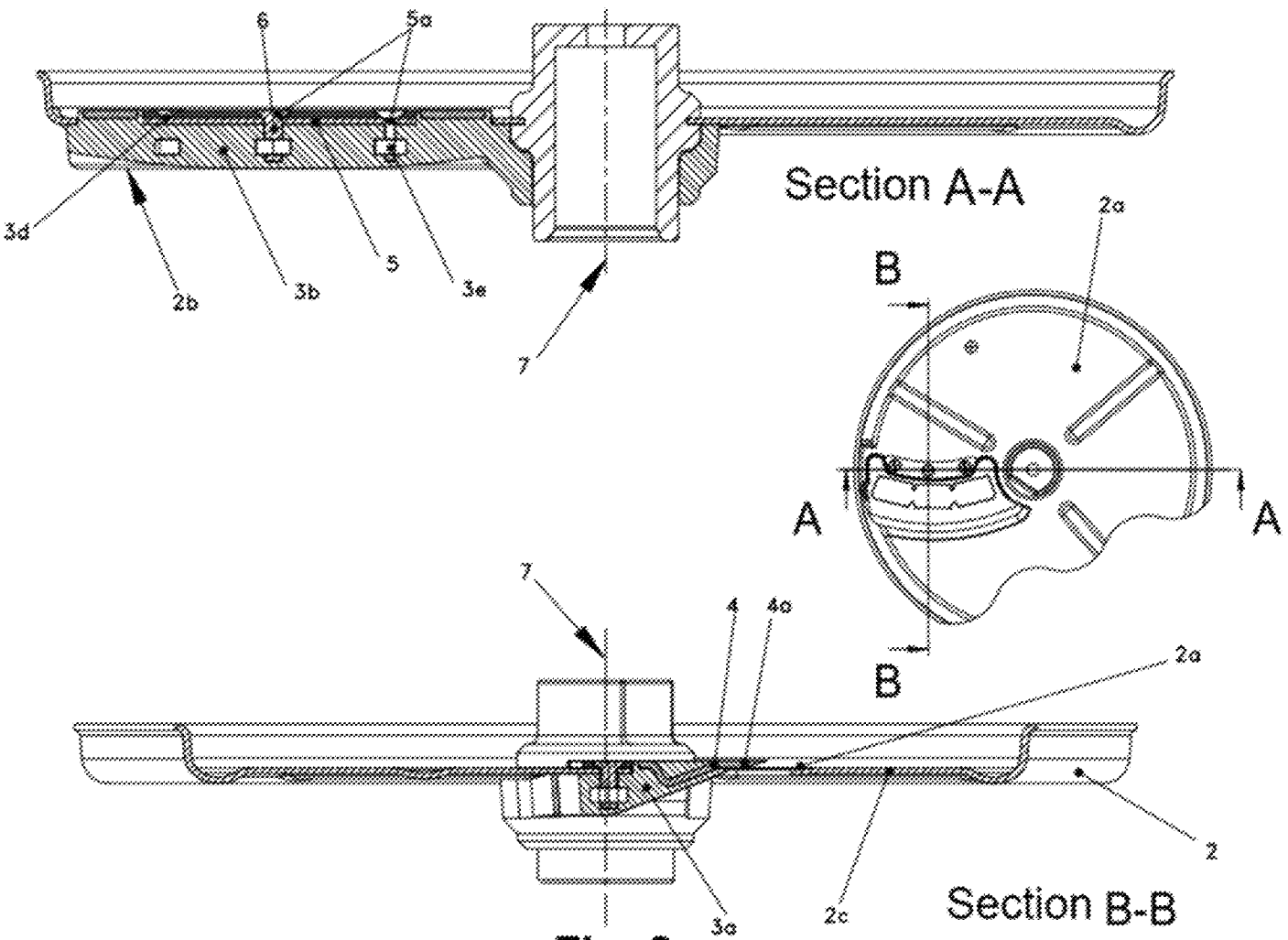
FIG. 2 shows two longitudinal cross-sectional views (A-A and B-B) of the rotating disc (2) of the improved removable cutting assembly (1) in which the lifting wedge (3*a*) is observed, located on the lower face (2*b*) on which a blade (4) is partially embedded with its cutting edge (4*a*) raised on the profile (2*c*) of the rotating disc (2), the fixing area (3*b*) of the flap (3) in which the nuts are embedded (3*e*) and all of this fixed to the rotating disc (2), together with the safety component (5), the whole assembly being tied up by means of the linking elements (6).
Figure 3:
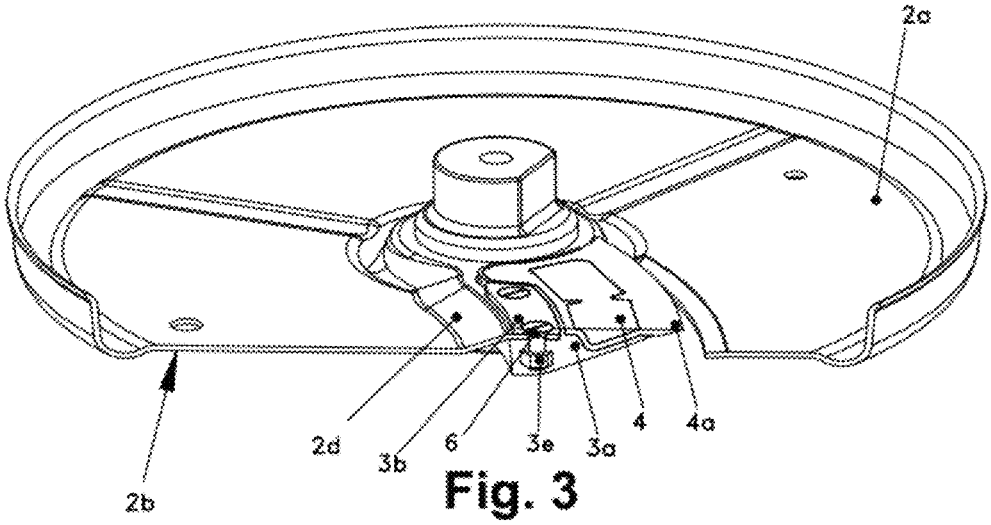
FIG. 3 shows a perspective view of the improved removable cutting assembly (1) with the rotating disc (2), in which a cut has been made showing the levelling platform (2*d*) in the fixing area (2*f*) and the perimeter of the pivot hole (2*g*) of the rotating disc (2) that levels the elevation of the cutting edge (4*a*) of the blade (4) on the upper face (2*a*) of the rotating disc (2). Furthermore, the nuts (3*e*) are shown embedded in the fixing area (3*b*) of the lifting wedge (3*a*), with a height of 1 mm and an angle of 21°, of the flap (3). It is shown how the assembly formed by the flap (3) together with the blade (4) and the safety component (5) is fixed by means of linking elements (6) to the rotating disc (2) and its cutting edge (4*a*) protrudes over the upper face (2*a*) of the disc (2).
Figure 4:
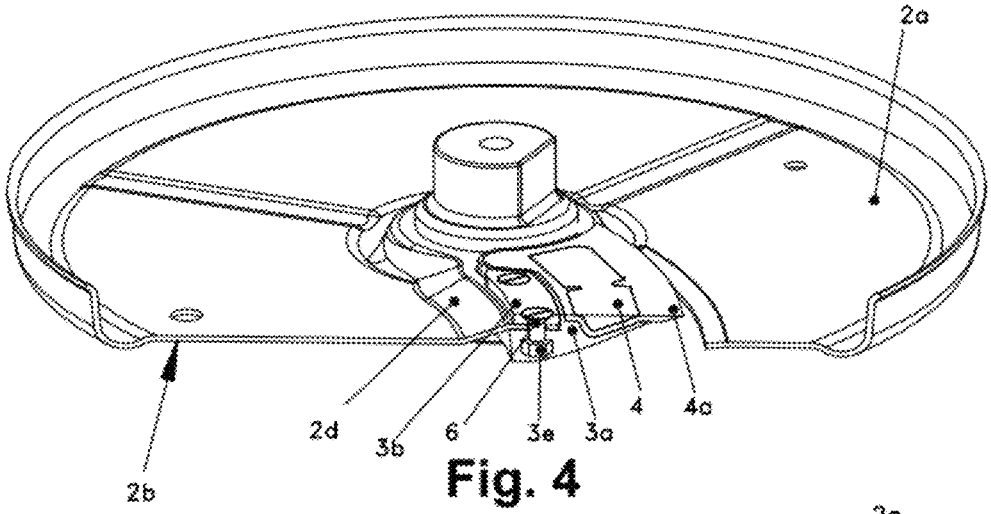
FIG. 4 shows a perspective view of the improved removable cutting assembly (1) with the rotating disc (2), in which a cut has been made showing the levelling platform (2*d*) in the fixing area (2*f*) and the perimeter of the pivot hole (2*g*) of the rotating disc (2) that levels the elevation of the cutting edge (4*a*) of the blade (4) on the upper face (2*a*) of the rotating disc (2). Furthermore, the nuts (3*e*) are shown embedded in the fixing area (3*b*) of the lifting wedge (3*a*), with a height of 2 mm and an angle of 23°, of the flap (3). It is shown how the assembly formed by the flap (3) together with the blade (4) and the safety component (5) is fixed by means of linking elements (6) to the rotating disc (2) and its cutting edge (4*a*) protrudes over the upper face (2*a*) of the disc (2).
Figure 5:
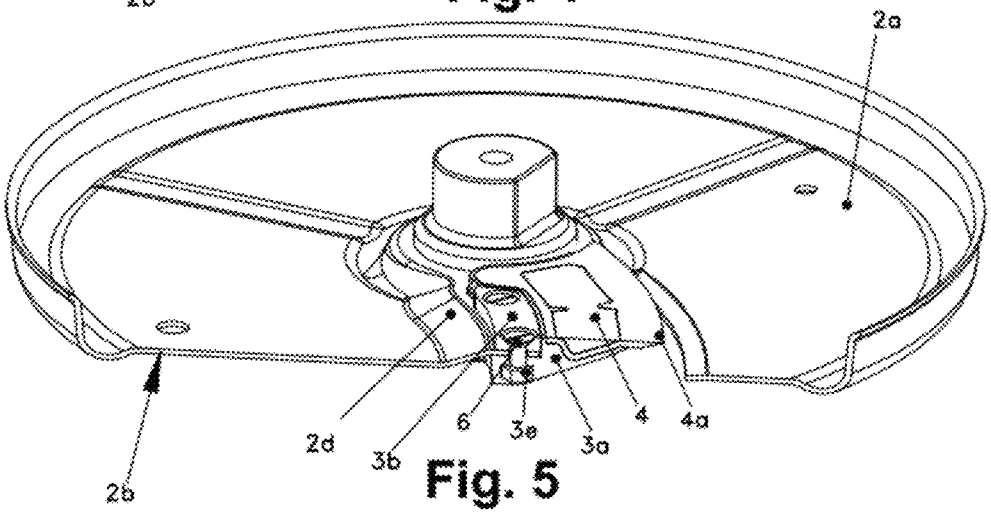
FIG. 5 shows a perspective view of the improved removable cutting assembly (1) with the rotating disc (2), in which a cut has been made showing the levelling platform (2*d*) in the fixing area (2*f*) and the perimeter of the pivot hole (2*g*) of the rotating disc (2) that levels the elevation of the cutting edge (4*a*) of the blade (4) on the upper face (2*a*) of the rotating disc (2). In addition, the nuts (3*e*) are shown embedded in the fixing area (3*b*) of the lifting wedge (3*a*), with a height of 3 mm and an angle of 23°, of the flap (3). It is shown how the assembly formed by the flap (3) together with the blade (4) and the safety component (5) is fixed by means of linking elements (6) to the rotating disc (2) and its cutting edge (4*a*) protrudes over the upper face (2*a*) of the disc (2).

As can be seen in FIG. 1, the cutting assembly (1) is removable, the linking elements (6) can be removed by being unscrewed by the operator; the safety component (5) housed on the fixing area (2*f*) of the rotating disc (2), the flap (3) linked to the rotation axis of the machine (7) by means of its insert ring (3*c*) and thus guaranteeing the cleanliness and hygiene of the whole, which is a fundamental requirement in the field of food product production to guarantee food safety. These FIGS. 1 and 2 also show the effective mooring of the different elements that make up the perfected removable cutting assembly (1), since the lifting wedge (3*a*) of the flap (3) is inserted protruding over the upper face (2*a*) of the rotating disc (2) and allowing the cutting of the edge (4*a*) of the blade (4) and the fixing area (3*b*) of the flap (3) will be housed on the lower face (2*b*) of the rotating disc (2), being tied to the rotating disc (2) by means of the safety component (5) located in the fixing area (2*f*) of the rotating disc (2) and the entire assembly aligned axially by inserting the insert ring (3*c*) of the flap (3), by the lower face (2*b*) of the rotating disc (2), to the rotation axis (7) of the cutting machine and being fixed by; the linking elements (6) through the fastening holes (5*a*) of the matching safety component (5); axially with the fixing holes (2*f*.1) of the rotating disc (2), with the fixing holes (3*d*) of the fixing area (3*b*) of the flap (3) and the nuts (3*e*) embedded in the fixing area (3*b*) of the flap (3). In addition, to allow the exchange and/or replacement of the flap (3) by kitchen personnel to be much simpler, the nuts (3*e*) are embedded in the fixing area (3*b*) of the flap (3), as can be seen in FIG. 2. In this manner, the kitchen staff only have to attend to the extraction of the linking elements (6), screws, without worrying about the extraction of the nuts (3*e*) to disassemble the set (1) which are always embedded in the fixing area (3*b*) and free of dirt or possible loss in the exchange of the flaps (3). Thus, the possibility of accumulation of food residues is eliminated, thus eliminating the possible contamination of the food and reducing the cutting time of the same, since an accumulation of residues causes a loss of efficiency during cutting. On the other hand, there will be a significant reduction in manufacturing costs since the injection material of the flap (3) is plastic that is cheaper than steel, which is the usual raw material in which the blade is manufactured (4), because, at the time of manufacture, only the dimensions of the plastic flap (3) must be modified, the blade (4) having the same dimensions for all slice thicknesses, when the user requires different flaps (3) to be used to obtain different slice thicknesses. As can be seen in FIGS. 3, 4, 5, there is a substitution of lifting wedges (3*a*) of different heights to be able to make the desired thickness cut by raising the height of the lifting wedge (3*a*), and also be able to affect its incline, which will be as smooth and small as possible, to optimize the slicing of the food without spoiling or damaging the product and avoiding breakage in the fibre of delicate foods. This is due to the fact that the elevation of the cutting edge (4*a*) of the blade (4) protruding over the upper face (2*a*) of the rotating disc (2), is determined by the height of the lifting wedge 11 (3*a*) of the flap (3) and the angle of incline thereof (between 21° and 23°). In this manner, we observe; in FIG. 3, a lifting wedge (3*a*) of a 1 mm height and angulation of 21°; in FIG. 4, a lifting wedge (3*a*) of a height of 2 mm and angulation of 23° and in the FIG. 5 a lifting wedge (3*a*) of a height of 3 mm and angulation of 23°. In this manner, the perfected removable cutting assembly (1) of the present invention is given great versatility due to the use of a multiplicity of lifting wedges (3*a*) of different heights and inclinations, allowing different thicknesses of the food slice to be obtained during the cutting process.

As can be seen in FIGS. 1 and 2, an advantageous characteristic of the present invention is that the lifting wedge (3*a*) of the flap (3) is perfectly inserted into the rotating disc (2), being efficiently housed and allowing the cutting edge (4*a*) of the blade (4) to protrude from the upper face (2*a*) of the rotating disc (2), thereby achieving an efficient cutting of the food slices without being damaged, as well as a better adjustment and fixation of the blade, its movements or vibrations being limited by the coupling with the window in almost the entire perimeter of the lifting wedge (3*a*). This advantageous aspect is achieved thanks to the fact that the window (2*e*) of the rotating disc (2) has a dimension and geometry corresponding to the dimension and geometry of the lifting wedge (3*a*) of the flap (3).

Moreover, there occurs; a distribution of efforts ensuring the fixation of both the blade (4) and the flap (3) to the rotating disc (2) and increasing the integrity of the fixation, and a reduction of the harmful vibrations originated when the food strikes against the blade (4) during the cutting process, which weakens the adjustment of the fixings, thereby achieving the homogenization of the thickness in the food slices, their integrity and homogeneous appearance. This advantageous characteristic aspect is due to the fact that, as can be seen in FIGS. 2, 3, 4 and 5, on the fixing area (2*f*) of the rotating disc (2) and attached to the lifting wedge (3*a*) a safety component is incorporated (5) consisting of at least one mooring hole (5*a*) coinciding with at least one mooring hole (2*f*.1) of the rotating disc (2) and at least one mooring hole (3*d*), and a nut (3*e*) of the wing (3).

Lastly, as can be seen in FIGS. 3, 4 and 5, with the use of a smaller number of lifting wedges (3*a*), a greater range of thicknesses of food slices can be achieved, thus providing the present invention with greater versatility. This is because the profile (2*c*) of the rotating disc (2) can contain a levelling platform (2*d*) in the fixing area (2*f*) and the perimeter of the pivot hole (2*g*) of the rotating disc (2) that levels the elevation of the cutting edge (4*a*) of the blade (4) on the upper face (2*a*) of the rotating disc (2), as seen in FIGS. 3, 4 and 5, preferably on the lower face (2*b*) of the rotating disc (2), although its incorporation on the upper face (2*a*) of the rotating disc (2) is also possible. For example, with a lifting wedge height (3*a*) of 1 mm and 21° of incline and without a levelling platform (2*d*) (FIG. 1), slices with a thickness of 1 mm are obtained. If we use an elevation of 2 mm in the lifting wedge (3*a*) with an incline of 23° and without levelling platforms (2*d*), slices with a thickness of 2 mm are obtained. When an elevation of 3 mm is used in the lifting wedge (3*a*) with an incline of 23° and without a levelling platform (2*d*), slices with a thickness of 3 mm are obtained. On the other hand, if rotating disks (2) are used with a levelling platform (2*d*) of a height of 3 mm, the following are achieved; slices of a thickness of 4 mm with a lifting wedge height of 1 mm (3*a*) and incline of 21°, slices of a thickness of 5 mm with a lifting wedge height of 2 mm (3*a*) and incline of 23° and slices of a thickness of 6 mm with a lifting wedge height (3*a*) of 3 mm and an incline of 23°. Therefore, six different thicknesses of food slices are achieved with the use of three lifting wedges (3*a*). Thanks to this additional advantageous characteristic, the present invention is provided with versatility and ease for the user when it comes to achieving a certain slice thickness of the food without deteriorating and having a suitable presentation thereof. Variations in materials, shape, size and arrangement of the component elements, described in a non-limiting manner, do not alter the essentiality of this invention, this being sufficient to proceed to its reproduction by an expert.

We claim:

1. A cutting assembly, comprising:

a rotating disc comprising a window, a disc fixing area adjacent said window, and a pivot hole, said rotating disc having an upper face and a lower face opposite said upper face, said disc fixing area having at least one fastening disc hole;

a flap being positioned on said lower face, wherein said flap comprises:

an insert ring axially aligned with said pivot hole:

a flap fixing area radially extending from said insert ring and having at least one fastening flap hole, and a lifting wedge extending from said flap fixing area toward said window, said flap fixing area being between said lower face and said lifting wedge;

at least one nut being embedded in said flap fixing area within said at least one fastening hole; and a blade having a cutting edge and being partially embedded and secured in said flap on said lower face by a safety component, said cutting edge protruding through said window to said upper face, wherein said flap fixing area is below said disc fixing area; and a linking element extending through said at least one fastening disc hole, said at least one fastening flap hole, and said at least one nut within said flap.

2. The cutting assembly, according to claim 1, wherein said window has a window dimension and a window geometry, wherein said lifting wedge has a wedge dimension and a wedge geometry, and wherein said window dimension and said window geometry correspond to said wedge dimension and said wedge geometry so as to protrude said cutting edge through said window.

3. The cutting assembly, according to claim 1, wherein the safety component comprises at least one mooring hole and is positioned over said disc fixing area on said upper face, said linking element extending through said at least one mooring hole of said safety component, said at least one fastening disc hole, said at least one fastening flap hole, and said at least one nut within said flap, wherein said safety component is positioned against said blade opposite said cutting edge.

4. The cutting assembly, according to claim 1, wherein said disc fixing area comprises a levelling platform configured to mount on a food cutting machine, said levelling platform extending around said pivot hole, said disc fixing area being raised above said upper face so as to level said cutting edge on said upper face.

* * * * *